United States Patent [19]

Abe

[11] Patent Number: 4,618,330

[45] Date of Patent: Oct. 21, 1986

[54] TOY AMUSEMENT DEVICE

[75] Inventor: Akira Abe, Tokyo, Japan

[73] Assignee: Tomy Kogyo Co. Inc., Tokyo, Japan

[21] Appl. No.: 693,842

[22] Filed: Jan. 22, 1985

[51] Int. Cl.[4] ..... A63H 1/00

[52] U.S. Cl. ..... 446/236; 446/265

[58] Field of Search ..... 446/236, 241, 246, 256, 446/265, 227, 238, 243, 244, 268, 360, 359, 242, 246, 259, 464, 420, 418

[56] References Cited

U.S. PATENT DOCUMENTS

| | | | |
|---|---|---|---|
| 755,446 | 3/1904 | Butcher . | |
| 1,594,649 | 8/1926 | Trautmann . | |
| 2,809,548 | 10/1957 | Brutting . | |
| 2,841,920 | 7/1958 | Balleis | 446/243 X |
| 3,919,804 | 11/1975 | Nakata | 446/464 |
| 4,455,781 | 6/1984 | Blumenthal | 446/241 |

*Primary Examiner*—Mickey Yu

*Attorney, Agent, or Firm*—K. H. Boswell

[57] ABSTRACT

An amusement toy includes a first member which is cylindrical in shape and is located within a housing. This first member is capable of rotating on the housing. A second elongated member is located within the center of the cylindrical shaped first member and moves up and down within the first member. A first gear located on the first member engages a connecting gear which in turn engages a gear located on the second member so as to transfer linear motion of the second member into rotational motion of the first member. Rotation of the first member transferred to at least one output member whereby the output member is rotated ultimately in response to linear motion of the second member.

19 Claims, 7 Drawing Figures

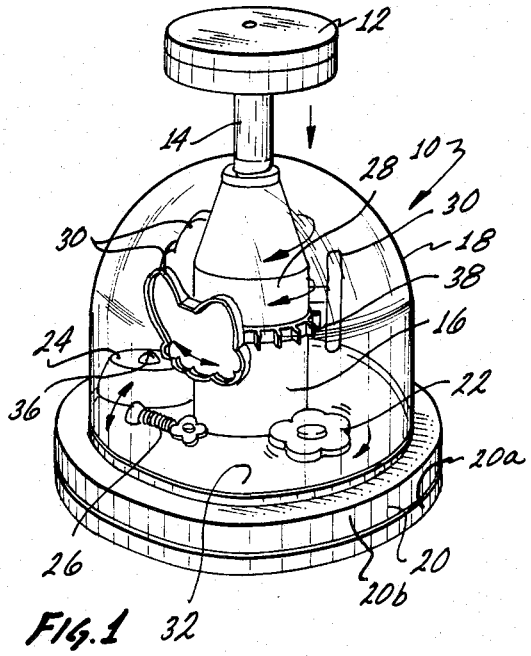
FIG. 1
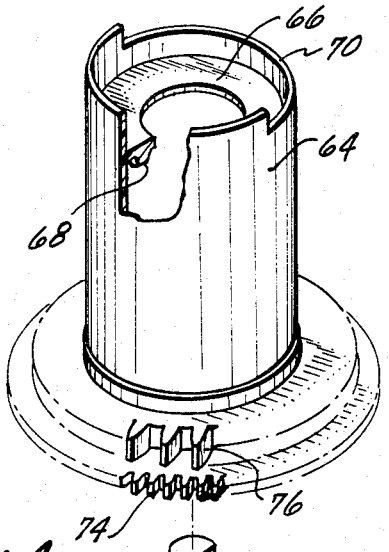
FIG. 4
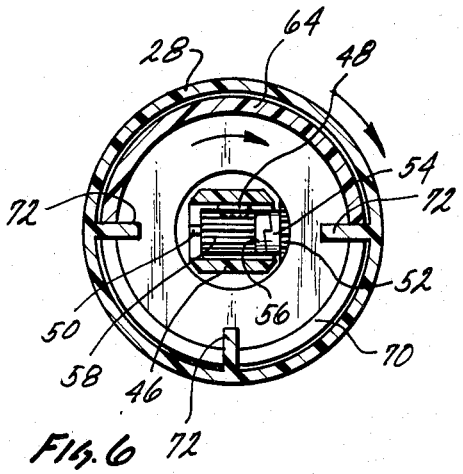
FIG. 6
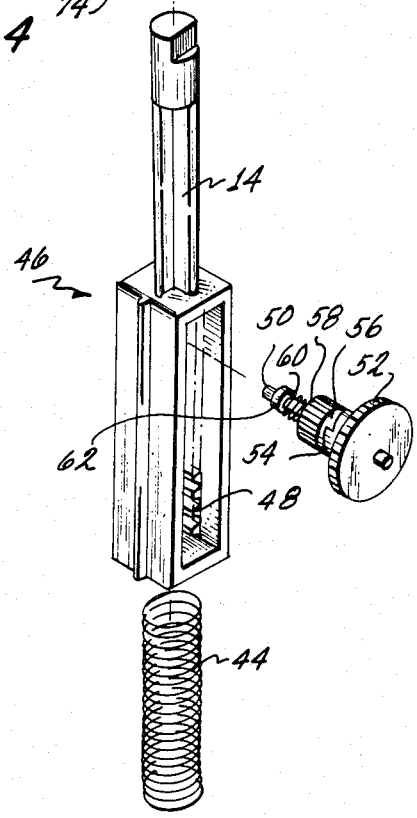

TOY AMUSEMENT DEVICE

BACKGROUND OF THE INVENTION

This invention is directed to an amusement toy capable of producing an output wherein the output is of an entertaining nature for a small child. Most specifically, the invention is directed to a toy which includes a first member capable of producing a rotational output and a second member associated with the first member wherein in response to linear movement of the second member, the first member is rotated.

A variety of amusement toys are known. Included are tops and other spinning type devices. These date back to antiquity. The simplest of these are nothing more than a carved wooded device which can be rapidly spun by winding a string around the device and pulling the string from the device.

The toy tops described in the preceeding paragraph, of course, require certain manual dexterity to operate. This precludes the use of these type of devices by small children. A device more suitable for use by a small child includes the common pump type rotating top toy. This toy utilizes a central shaft which the child pumps up and down in order to impart a rotational momentum to a flywheel portion of the toy. These types of toys have been equipped with music boxes and the like, so as to emit a noise in response to spinning of the rotational member of the toy.

The toys described in the preceeding paragraph have been quite popular for several decades because of the play value inherent therein. They, however, require use upon a hard surface because the housing of the toy itself spins. If these types of toys were utilized on a soft surface, such as a rug or the like, the momentum of the toy is easily dissapated because of friction between the housing and the softer surface.

BRIEF DESCRIPTION OF THE INVENTION

In view of the above, it is a broad object of this invention to provide a top-type of toy wherein the outer housing itself is not rotated, but includes further elements formed as a portion of the toy which are rotated so as to produce an enjoyable and amusing output for the user of the device. It is a further object of this invention to provide a toy which is easily utilized by small children without adult supervision, thus allowing the small child to enjoy the toy by himself. It is a further object of this invention to provide a toy which, because of the engineering principles inherent therein, is capable of a long and useful lifetime by a small child, yet is also capable of being manufactured at an economical price for the consumer.

These and other objects, as will become evident from the remainder of the specification, are achieved in a toy which comprises a housing; first and second members located on said housing; said first member shaped as a surface of rotation having a hollow interior and open ends opening into said hollow interior, said first member rotatably mounted on said housing; said second member being elongated in shape and located on said housing so as at least a portion of said second member is located within the hollow interior of said first member with at least a portion of said second member extending out of one of said ends of said first member, said second member linearly movable in and out of one of said ends of said first member; first gear means located on said first member; second gear means located on said second member; connecting gear means located on said housing in operative association with both said first and said second gear means so as to transfer linear motion of said second member into rotational motion of said first member; output means independent of said first member, said output means movably located on said housing in operative association with said first member whereby rotational motion of said first member moves said output means on said housing.

In the illustrative embodiment of the invention, the connecting gear means includes a clutch means whereby motion of the second member is only transferred to the first member when the second member moves in a first direction, not in a second direction. Further, in the illustrative embodiment, a biasing means is associated with the second member whereby when the second member is pushed from an initial position to a subsequent position, the biasing means is energized such that it then pushes the member from the subsequent position back to the initial position.

Further, in the illustrative embodiment, the housing includes an upstanding element shaped as a surface of rotation mimicking the shape of the first member whereby the first member fits around the upstanding element and it is rotated thereon in response to movement of the second member. The connecting gear means is journalled in the upstanding member, so as to hold it in position to engage both the first member and the second member.

BRIEF DESCRIPTION OF THE DRAWINGS

This invention will be better understood when taken in conjunction with the drawings wherein:

FIG. 1 is an isometric view of an embodiment of the invention;

FIG. 4 is an exploded isometric view of certain of the components generally located in the central portions of FIGS. 2 and 3;

FIG. 6 is a sectional view about the line 6—6 of FIG. 3; and

Figure 7:
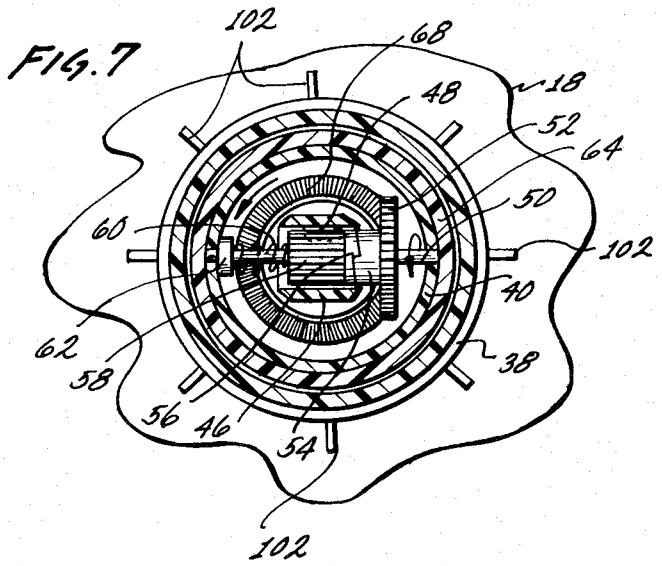
FIG. 7 is a sectional view about the line 7—7 of FIG. 3.

This invention utilizes certain principles and/or concepts as are set forth in the claims appended hereto. Those skilled in the toy arts will realize that these principles and/or concepts are capable of being expressed in a variety of embodiments which may differ from the exact embodiment utilized for illustrative purposes. For this reason this invention is not to be construed as being limited solely to the illustrative embodiment, but should only be construed in view of the claims.

DETAILED DESCRIPTION OF THE INVENTION

FIG. 1 shows an amusement toy 10 which is primarily designed for use by very small children. It requires a minimum of manipulative skills in order to "play" with the toy. As such, it is suitable for toddler age children. However, it also has a certain asthetic appeal and, as such, is further suitable as a collector type item for older children and even adults.

To activate the amusement toy 10 one only needs to depress downwardly on the large button 12 which is located on the top of the toy. This in turn transfers downward movement to a shaft 14 which is attached to the bottom of the button 12. Pushins on the button 12 pushes the shaft 14 into the interior of the housing 16. The housing 16 and other componenets located thereon are viewable through a transparent cover 18 which in turn attaches to a base 20.

Located on the base 20 so as to rotate on the base 20, is a small rotating flower-shaped disk 22. Further, a bell 24 is located on the base 20 in association with a bell clanger 26. Formed as a part of the interior housing 16 is a first rotating element 28 which includes a plurality of second rotating elements collectively identified by the numeral 30.

When the button 12 is depressed, this activates certain mechanisms within the interior of the toy as hereinafter described. Upon release of the button 12, the shaft 14 and the button 12 slowly move upwardly and, in doing so, activate mechanisms within the interior of the toy 10 causing rotation of the first rotating element 28 and the second rotating elements 30 attached thereto, rotation of the flower-shaped disk 22 and movement of the clanger 26 against the bell 24 so as to produce an audio output from the bell 24. The button 12 and the shaft 14 can be moved into the interior of the housing 16 very fast. However, movement of the shaft 14 upwardly out of the housing 16 is much slower, such that the outputs of the toy 10, i.e. the rotation of the components 22, 26, and 28, and the noise emitted from the bell 24, are evident over an extended time period.

Figure 2:
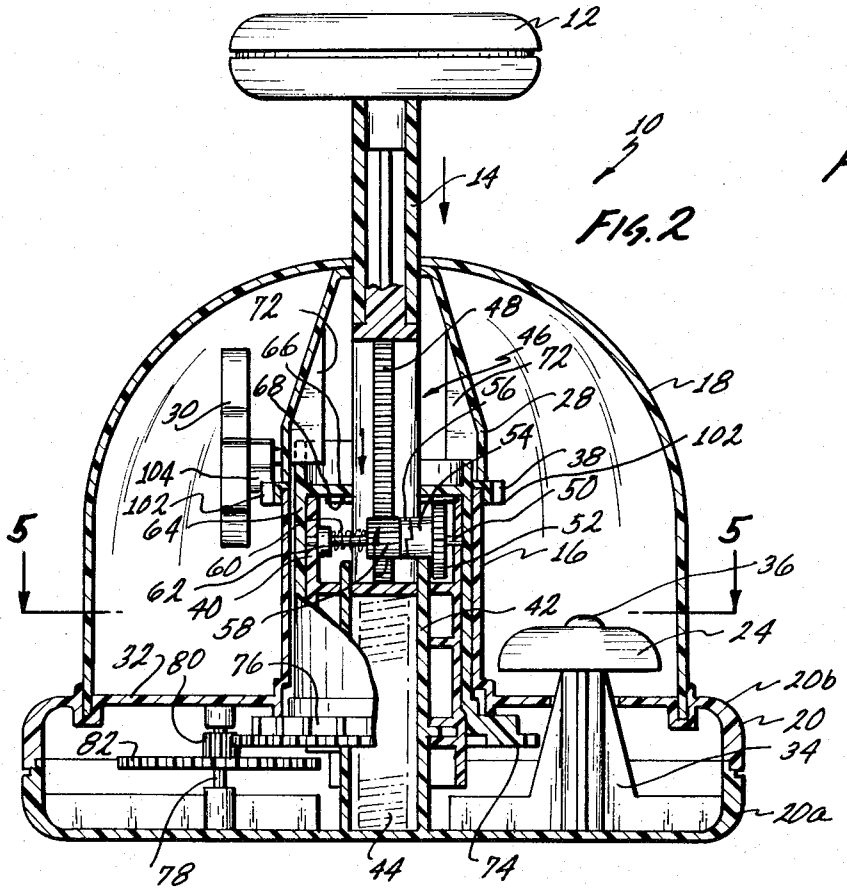
FIG. 2 is a side elevational view in section of the embodiment shown in FIG. 1 with certain of the components in a first spacial configuration.
Figure 3:
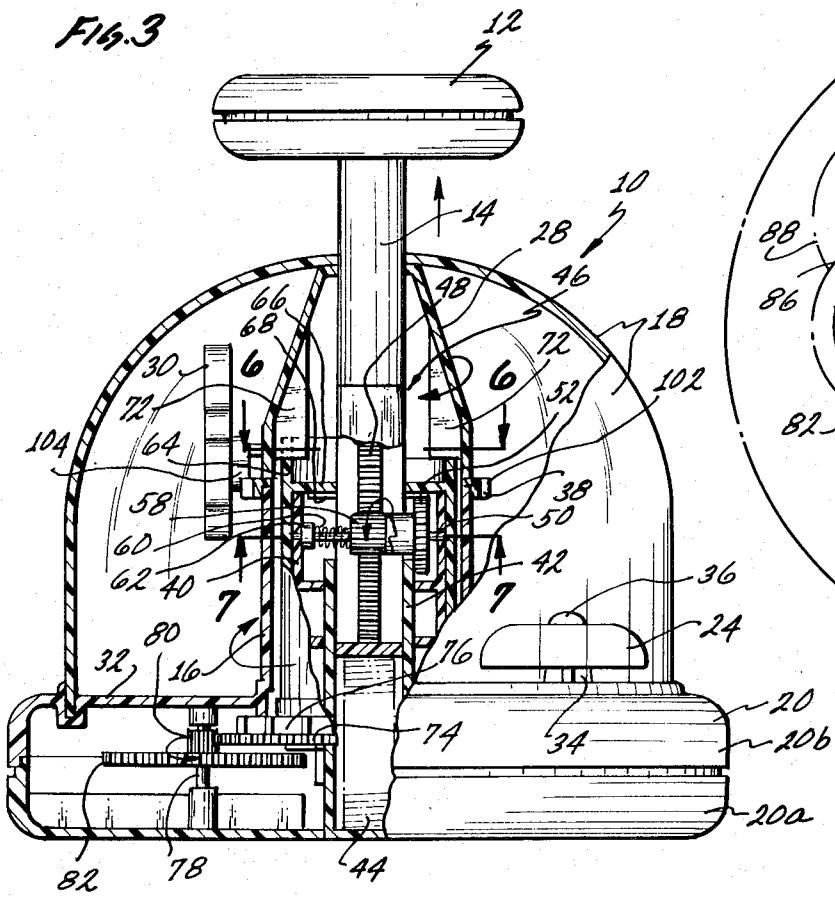
FIG. 3 is a side elevational view similar to FIG. 2 except that certain of the components are shown in a second spacial configuration.

As is evident from FIGS. 2 and 3, the base 20 is hollow. It is composed of lower base member 20a and upper base member **20*b* which fit together. The upper base member 20*b* includes a surface 32 located thereon. A bell support member 34 extends upwardly from the lower base member 20*a* through an opening not separately identified or numbered in the surface 32. The bell 22 is attached via a screw 36 to the bell support member 34. Extending upwardly centrally from the surface 32 is the housing 16. On the upper periphery of the housing 16 is a collar 38 whose function will be described below. Directly above the collar 38 is the first rotating element 28. The first rotating element 28 includes a central top opening through which the shaft 14** passes.

Figure 5:
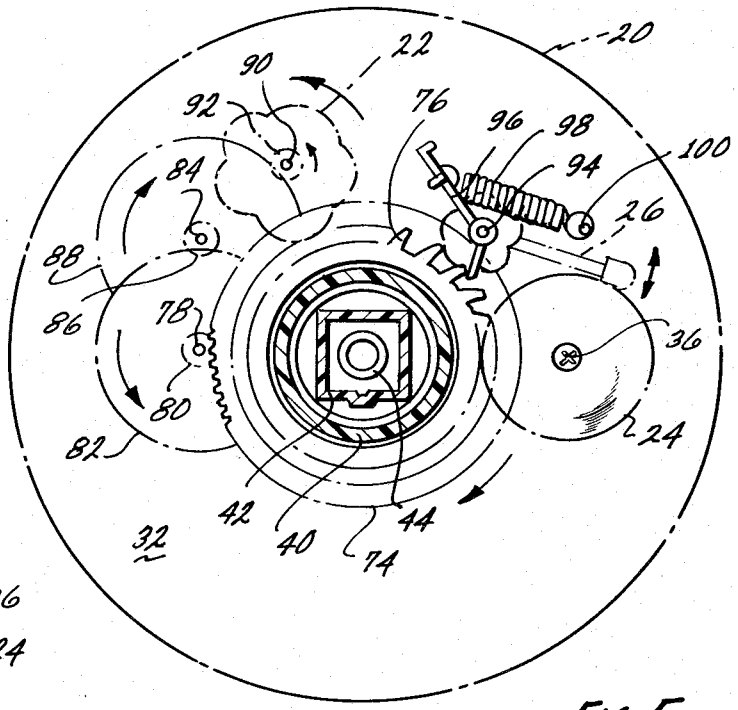
FIG. 5 is a plan view in partial section about the line 5—5 of FIG. 2.

Referring briefly to FIG. 5, located within the housing 16 is a further interior housing 40. The interior housing 40 is shaped as a cylindrical surface of rotation and includes a hollow interior. The interior housing 40 is fixed to the lower base member **20*a*. The interior housing 40 is hollow and is open at its upper end. Located within the hollow interior of interior housing 40 is a guide 42. Guide 42 is square in shape in cross section as seen in FIG. 5, and contains a compression spring 44** within its bottom most portion.

The shaft 14 is formed as a upper portion of a first moving member 46. The lower portion of the first moving member 46, as is best seen in FIG. 4, is formed as an open sided elongated parallelopiped. Within the interior of this portion of the first moving member 46 is a gear rack 48. The gear rack is on one of the solid faces, with the open faces exposing both the left and right hand side of the gear rack. The square shape in cross section of the bottom portion of the first moving member 46 allows it to fit within the guide 42 with the square shape of the guide 42 limiting the movement of the first moving member 46 linearly upperwardly and downwardly within it.

A shaft 50 is journalled across the top of the interior housing 40 directly above the guide 42. Fixedly located onto the shaft 50 is a spur gear 52. The spur gear 52 includes a reentrant gear 54 formed as an intrical part thereof. A further reentrant gear 56 mates with reentrant gear 54. Formed as a portion of reentrant gear 56 is a pinion 58. The pinion 58 and reentrant gear 56 are free to rotate on the shaft 50 but are biased by a compression spring 60 which is positioned between a bushing 62 and the pinion 58. The compression spring 60, pushing against the pinion 58, engages reentrant gear 56 with the reentrant gear 54. The engagement of the reentrant gears 54 and 56 with one another, serve as a clutch. The shape of these reentrant gears is such that they include helical extending surfaces in one direction and a locking tooth in the other direction. As viewed in FIG. 4, if the pinion 58 is rotated counterclockwise, this rotation will be tranferred to the spur gear 52 so as to rotate it counterclockwise. However, if the pinion 58 is rotated counterclockwise, and for any reason the spur gear 52 is inhibited from easily rotating, the reentrant gear 56 will slip across the helical surface of the reentrant gear 54 such that rotation of the pinion 58 in a clockwise direction is not transferred to the spur gear 52.

The pinion 58 is in mesh with the gear rack 48. Upon depression of the button 12, downward movement of the first moving member 46 within the guide 42 causes clockwise rotation of the pinion 58 such that the reentrant gear 56 slips against the surface of the reentrant gear 54, and the pinion 52 is not rotated. This, however, does compress the compression spring 44. When the button 12 is released, the bias induced in the compression spring 44 pushes the first moving member 46 upwardly, thus causing the gear rack 48 to rotate the pinion 58 counterclockwise. This rotation is transferred via the reentrant gears 54 and 56 to the spur gear 52 so as to rotate the spur gear 52 counterclockwise as seen in FIG. 4.

A second moving member 64 includes a cylindrical surface of rotation which fits around the interior housing 40. This allows the second moving member 64 to rotate about the interior housing 40. An interior radially extending flange 66 has a set of crown teeth 68 located on its under side. These are positioned so as to engage with the spur gear 52. Rotation of the spur gear 52 is therefore transferred to the crown teeth 68 rotating the second moving member 64. Thus, the linear movement of the first moving member 46 is transferred via the pinion 58 and spur gear 52 to the second moving member 64 to rotate it.

The second moving member 64 includes a cutout area 70 which extends around 180° of the top edge of the second moving member 64. This engages with interior webs 72 formed within the interior of the first rotating element 28. Rotation of the second moving member 64 is thus directly transferred to the first rotating element 28.

A large spur gear 74 is formed on the bottom of the second moving member 64. Formed directly above the spur gear 74 is a set of ratchet teeth 76. Since each of these is intrically formed with the second moving member 64, they, of course, rotate in conjunction with rotation of the second moving member 64.

A shaft 78 is journalled between the upper and lower base members 20*a* & 20*b* so as to freely rotate. Fixedly located on the shaft 78 is a small pinion 80, and intrically formed with the pinion 80 is a large spur gear 82. The pinion 80 meshes with the spur gear 74 formed on the bottom of the second moving member 64. Located next to the outer periphery of the spur gear 82 is a further shaft 84 which is also journalled between the upper and lower base members 20*a* & 20*b*. A pinion 86 and a spur gear 88, intrically formed with pinion 86, are located on the shaft 84. The pinion 84 meshes with the spur gear 82 so as to ultimately be rotated in response to rotation of the second moving member 64.

The disk 22 is fixed to a shaft 90 which is journalled in the upper base 20*b*. The shaft 90 passes through the surface 32 and includes a pinion 92 fixed to the shaft 90 and located below the surface 32. Both the pinion 92 and the disk 22 are fixed to the shaft 90 such that rotation of the pinion 92 is transferred to the disk 22. The pinion 92 meshes with the spur gear 88. Because of this, ultimately the disk 22 is rotated in response to rotation of the second moving member 64.

The clanger 26 is fixed to a shaft 94. As seen in FIG. 5, the shaft 94 passes through the surface 32 on the upper base 20*b*. Located on the shaft 94 below the surface 32 is a lever 96. The lever 96 is fixed to the shaft 94 such that movement of the lever 96 is transferred via the shaft 94 to the clanger 26.

Attached to one end of the lever 96 is a spring 98. The spring 98 stretches between the lever 96 and a small peg 100 which extends downwardly from the bottom of the surface 32. The spring 98 has a small amount of tension incorporated therein such that the other end of the lever 96 is biased towards and meshes with the ratchet teeth 76. As the second moving member 64 rotates, each of the ratchet teeth 76 in turn contact the lever 96 to rotate the lever 96. In doing so, this stretches the spring 98 and pulls the clanger 26 away from the bell 24. As seen in FIG. 5, when the lever 98 has cleared the particular ratchet tooth which it was engaged with, the tension within the spring 98 rotates the lever 96 clockwise to bring the end of the clanger 26 against the bell 24 to ring the bell 24.

As noted above, located on top of the housing 16 is a collar 38. The collar 38 includes a plurality of small webs collectively identified by the numeral 102 which extends radially from it. Each of the second rotating elements 30 also include a small web 104 which projects downwardly. The webs 104 are positioned whereby they are engaged by the webs 102 as the first rotating element 28 rotates on top of the housing 16. Each time one of the webs 104 on one of the second rotating elements 30 contacts one of the webs 102, the second rotating element 30 is rotated on the first rotating element 28. As soon as the web 104 passes over the particular web 102, the second rotating element 30 rotates in the opposite direction. Because of this, as the first rotating element 28 rotates on the housing 16, the second rotating element 30 rotates on the first rotating element 28.

In FIG. 2, the button 12 is being depressed and the reentrant gear 56 is slipping on the reentrant gear 54. Depressing of the button 12 moves the first moving member 46 downwardly to compress the spring 44. When the button 12 is released, the tension created in the spring 44 moves the first moving member 46 upwardly. However, at this time the reentrant gear 56 engages reentrant gear 54 so as to transfering the upward linear motion of the first moving member 46 to rotary motion of the second moving member 64 via the gears described previously. Since the second moving member 64 includes the large spur gear 74 on its periphery which engages a small pinion 80, and since the pinion 80 is intrically formed with large spur gear 82 which engages a small pinion 86, and further since the pinion 86 is intrically formed with large spur gear 88 which engages a small pinion 92, a small increment of rotation of the second moving member 64 is compounded to a large increment movement of the disk 22. In compounding the rotation from the second moving member 64 to the disk 22, the gear train between the disk 22 and the second moving member 64 serves as a speed govenor for the speed of rotation of the second moving member 64. In view of this, the bias created within the spring 44 is slowly released as the second moving member 64 slowly rotates. The disk 22, however, is rapidly rotating. The clanger 26, since it is driven by the ratchet teeth 76 which are on the second moving member, and the first and second rotating elements 28 and 30, since they also are in direct contact with the rotating member 64, move at a rate equal to the rate of rotation of the second moving member 64.

I claim:

1. A toy which comprises:

a housing;

first and second members located on said housing;

said first member shaped as a surface of rotation having a hollow interior and open ends opening into said hollow interior, said first member rotatively mounted on said housing;

said second member being elongated in shape and located on said housing so as at least a portion of said second member is located within the hollow interior of said first member with at least a portion of said second member extending out of one of said ends of said first member, said second member linearly movable in and out of one of said ends of said first member;

first gear means located on said first member;

second gear means located on said second member;

connecting gear means located on said housing in operative association with both said first and said second gear means so as to transfer linear motion of said second member into rotational motion of said first member;

output means for producing a mechanical output, said output means independent of said first member, said output means movably located on said housing in operative association with said first member whereby rotational motion of said first member moves said output means on said housing;

said housing includes an upstanding element shaped as a surface of rotation mimicking the shape of the surface of rotation of said first member, said upstanding element sized and shaped so as to fit within the interior of said first member whereby said first member rotates around said upstanding element;

said upstanding element further including an opening located through the interior of said upstanding element, said opening sized and shaped so as to contain at least a portion of said second member;

said first member rotating around said upstanding element in response to movement of said second member with respect to said upstanding element.

2. The toy of claim 1 wherein:

said connecting gear means is rotatively mounted to said upstanding element in a position so as to contact both said first and said second members.

3. The toy of claim 1 including:

biasing means associated with said second member;

said second member movable between an initial position and a subsequent position, said second member in moving from said initial position to said subsequent position inducing a bias into said biasing means whereby in response to said bias introduced into said biasing means, said biasing means moves said second member from said subsequent position back to said initial position.

4. The toy of claim 3 wherein:

said connecting gear means includes a clutch means, said clutch means for transferring motion of said second member to said first member so as to rotate said first member when said second member moves in a first direction and disrupting the transfer of motion between said second member to said first member when said second member moves in a second direction whereby said first member does not rotate in response to movement of said second member in said second direction;

said second member in moving from said initial position to said subsequent position moves in said second direction, and in moving from said subsequent position to said initial position moves in said first direction.

5. The toy of claim 1 including:

a second output means;

said second output means operatively associated with said first member so as to be rotated in response to rotation of said first member;

said second output means includes a first element rotatively mounted on said housing, said first element operatively connected to said first member so as to be rotated on said housing in response to rotation of said first member on said housing;

said second output means further including at least one second element rotatively mounted to said first element;

second element moving means, said second element moving means operatively associated between said housing and said second element whereby as said first element moves on said housing, said second element moving means rotates said second element with respect to said first element.

6. The toy of claim 1 wherein:

said second member includes an elongated opening;

said second gear means comprising a gear rack located within the interior of said opening;

said connecting gear means having at least a portion thereof lcoated within said opening so as to contact said gear rack and be rotated by said gear rack in response to linear movement of said second member.

7. A toy which comprises:

a housing;

first and second members located on said housing;

said first member shaped as a surface of rotation having a hollow interior and open ends opening into said hollow interior, said first member rotatively mounted on said housing;

said second member being elongated in shape and located on said housing so as at least a portion of said second member is located within the hollow interior of said first member with at least a poriton of said second member extending out of one of said ends of said first member, said second member linearly movable in and out of one of said ends of said first member;

first gear means located on said first member;

second gear means located on said second member;

connecting gear means located on said housing in operative association with both said first and said second gear means so as to transfer linear motion of said second member into rotational motion of said first member;

output means for producing a mechanical output, said output means independent of said first member, said output means movably located on said housing in operative association with said first member whereby rotational motion of said first member moves said output means on said housing;

said output means including gear train means located in association with said first member;

said first member including third gear means located thereon, said third gear means engaged with said gear train means so as to rotate said gear train means in response to rotation of said first member with respect to said housing;

said output means further including movable means located on said housing in operative association with said gear train means so as to be moved by said gear train means.

8. The toy of claim 7 including:

biasing means associated with said second member;

said second member movable between an initial position and a subsequent position, said second member in moving from said initial position to said subsequent position inducing a bias into said biasing means whereby in response to said bias introduced into said biasing means, said biasing means moves said second member from said subsequent position back to said initial position.

9. The toy of claim 7 wherein:

said output means includes audible means capable of emitting a noise in repsonse to rotation of said gear train means.

10. The toy of claim 7 further including:

a second output means;

said second output means operatively associated with said first member so as to be rotated in response to rotation of said first member.

11. The toy of claim 10 wherein:

said second output means includes a first element rotatably mounted on said housing, said first element operatively connected to said first member so as to be rotated on said housing in response to rotation of said first member on said housing;

said second output means further including at least one second element rotatively mounted to said first element;

second element moving means, said second element moving means operatively associated between said housing and said second element whereby as said first element moves on said housing, said second element moving means rotates said second element with respect to said first element.

12. The toy of claim 11 wherein:

said second element moving means includes a portion thereof fixedly mounted on said housing and a further portion thereof located on said second element, said portion of said second element moving means located on said second element contacting the portion of said second element moving means located on said housing as said first member rotates with respect to said housing so as to rotate said second element with respect to said first element.

13. The toy of claim 7 wherein:

said second member includes an elongated opening;

said second gear means comprising a gear rack located within the interior of said opening;

said connecting gear means having at least a portion thereof located within said opening so as to contact said gear rack and be rotated by said gear rack in response to linear movement of said second member.

14. A toy which comprises:

a housing;

first and second members located on said housing;

said first member shaped as a surface of rotation having a hollow interior and open ends opening into said hollow interior, said first member rotatively mounted on said housing;

said second member being elongated in shape and located on said housing so as at least a portion of said second member is located within the hollow interior of said first member with at least a portion of said second member extending out of one of said ends of said first member, said second member linearly movable in and out of one of said ends of said first member;

first gear means located on said first member;

second gear means located on said second member;

connecting gear means located on said housing in operative association with both said first and said second gear means so as to transfer linear motion of said second member into rotational motion of said first member;

output means for producing a mechanical output, said output means independent of said first member, said output means movably located on said housing in operative association with said first member whereby rotational motion of said first member moves said output means on said housing;

said second member includes an elongated opening;

said second gear means comprising a gear rack located within the interior of said opening;

said connecting gear means having at least a portion thereof located within said opening so as to contact said gear rack and be rotated by said gear rack in response to linear movement of said second member.

15. The toy of claim 14 wherein:

said connecting gear means includes a clutch means, said clutch means for transferring motion of said second member to said first member so as to rotate said first member when said second member moves in a first direction and disrupting the transfer of motion between said second member to said first member when said second member moves in a second direction whereby said first member does not rotate in response to movement of said second member in said second direction.

16. The toy of claim 14 including:

a second output means;

said second output means operatively associated with said first member so as to be rotated in response to rotation of said first member;

said second output means includes a first element rotatively mounted on said housing, said first element operatively connected to said first member so as to be rotated on said housing in response to rotation of said first member on said housing;

said second output means further including at least one second element rotatively mounted to said first element;

second element moving means, said second element moving means operatively associated between said housing and said second element whereby as said first element moves on said housing, said second element moving means rotates said second element with respect to said first element.

17. The toy of claim 14 wherein:

said connecting gear means is rotatively mounted to said upstanding element in a position so as to contact both said first and said second members.

18. The toy of claim 15 including:

biasing means associated with said second member;

said second member movable between an initial position and a subsequent position, said second member in moving from said initial position to said subsequent position inducing a bias into said biasing means whereby in response to said bias introduced into said biasing means, said biasing means moves said second member from said subsequent position back to said initial position.

19. The toy of claim 18 wherein:

said second member in moving from said initial position to said subsequent position moves in said second direction, and in moving from said subsequent position to said initial position moves in said first direction.

* * * * *

UNITED STATES PATENT AND TRADEMARK OFFICE

CERTIFICATE OF CORRECTION

PATENT NO. : 4,618,330

DATED : Oct. 21, 1986

INVENTOR(S) : AKIRA ABE

It is certified that error appears in the above-identified patent and that said Letters Patent is hereby corrected as shown below:

Column 1, line 16, "wooded" should read --wooden--.

Column 3, line 7, "Pushins" should read --Pushing--.

Column 4, line 66, "intrically" should read --integrally--.

Column 5, lines 3 and 10, "intrically" should read --integrally--.

Column 5, line 67, delete "so as to".

Column 6, lines 5 and 7, "intrically" should read --integrally--.

Column 7, line 68, "poriton" should read --portion--.

Signed and Sealed this

Fourteenth Day of April, 1987

*Attest:*

*Attesting Officer*

DONALD J. QUIGG

*Commissioner of Patents and Trademarks*